US009696008B2

(12) United States Patent
Hunter

(10) Patent No.: US 9,696,008 B2
(45) Date of Patent: Jul. 4, 2017

(54) REFLECTOR FOR DIRECTED BEAM LED ILLUMINATION

(71) Applicant: Vivian L. Hunter, Simsbury, CT (US)

(72) Inventor: Vivian L. Hunter, Simsbury, CT (US)

(73) Assignee: Cooper Technologies Company, Houston, TX (US)

( * ) Notice: Subject to any disclaimer, the term of this patent is extended or adjusted under 35 U.S.C. 154(b) by 0 days.

(21) Appl. No.: 13/933,818

(22) Filed: Jul. 2, 2013

(65) Prior Publication Data

US 2015/0009678 A1 Jan. 8, 2015

(51) Int. Cl.

| | |
|---|---|
| ***F21V 7/04*** | (2006.01) |
| ***F21V 7/09*** | (2006.01) |
| ***F21V 7/06*** | (2006.01) |
| *F21V 7/22* | (2006.01) |
| *F21V 17/12* | (2006.01) |
| *F21V 19/00* | (2006.01) |
| *F21W 111/06* | (2006.01) |
| *F21Y 105/10* | (2016.01) |
| *F21Y 115/10* | (2016.01) |

(52) U.S. Cl.

CPC ..... *F21V 7/04* (2013.01); *F21V 7/06* (2013.01); *F21V 7/09* (2013.01); *F21V 7/22* (2013.01); *F21V 17/12* (2013.01); *F21V 19/0035* (2013.01); *F21W 2111/06* (2013.01); *F21Y 2105/10* (2016.08); *F21Y 2115/10* (2016.08)

(58) Field of Classification Search

CPC ..... F21S 48/1757; F21S 48/1388; F21S 4/00; F21Y 2101/02; F21V 7/00; F21V 7/06; F21V 29/00

USPC ..... 362/241, 243, 247, 296.01, 327, 341, 362/459–549

See application file for complete search history.

(56) References Cited

U.S. PATENT DOCUMENTS

| | | | | |
|---|---|---|---|---|
| 3,390,262 | A * | 6/1968 | Elmer | 362/217.07 |
| 4,242,725 | A * | 12/1980 | Douma et al. | 362/341 |
| 4,261,030 | A * | 4/1981 | Hernandez | 362/296.01 |
| 4,336,576 | A * | 6/1982 | Crabtree | 362/240 |
| 7,040,782 | B2 | 5/2006 | Mayer | |

(Continued)

FOREIGN PATENT DOCUMENTS

| | | |
|---|---|---|
| CN | 202432395 U | 9/2012 |
| DE | 102010018178 | 10/2011 |

(Continued)

OTHER PUBLICATIONS

Trofimova, M., International Search Report and Written Opinion of the International Searching Authority for PCT/US2014/045016, completed on Sep. 23, 2014, mailing date Oct. 30, 2014, pp. 1-8.

(Continued)

*Primary Examiner* — Jong-Suk (James) Lee
*Assistant Examiner* — Christopher E Dunay
(74) *Attorney, Agent, or Firm* — King & Spalding LLP

(57) ABSTRACT

The present disclosure provides systems and techniques for directing light into one or more light beams which converge into an aggregate beam. In certain example embodiments, the present disclosure provides a reflector having one or more reflective curved surfaces for reflecting and focusing light from one or more light emitting diodes (LEDs) into one or more light beams, which make up an aggregate light beam. In certain example embodiments, the reflective curved surfaces are paraboloid surfaces.

17 Claims, 4 Drawing Sheets

(56) References Cited

U.S. PATENT DOCUMENTS

| | | | | |
|---|---|---|---|---|
| 7,070,301 | B2 | 7/2006 | Magarill | |
| 8,425,090 | B2 * | 4/2013 | Foo | 362/341 |
| 8,475,021 | B2 * | 7/2013 | Iwasaki et al. | 362/519 |
| 2003/0043590 | A1 * | 3/2003 | Walser | B60Q 1/2665 362/494 |
| 2004/0114366 | A1 | 6/2004 | Smith et al. | |
| 2005/0122737 | A1 * | 6/2005 | Watanabe et al. | 362/544 |
| 2007/0153530 | A1 * | 7/2007 | Czajkowski | 362/341 |
| 2008/0232102 | A1 | 9/2008 | Martineau et al. | |
| 2009/0257240 | A1 * | 10/2009 | Koike | F21S 48/1159 362/538 |
| 2011/0116284 | A1 * | 5/2011 | Richardson | 362/555 |
| 2012/0026728 | A1 | 2/2012 | Lou et al. | |
| 2012/0063156 | A1 * | 3/2012 | Yasuda et al. | 362/516 |
| 2012/0120673 | A1 * | 5/2012 | Anderson et al. | 362/514 |
| 2012/0300485 | A1 * | 11/2012 | Lee | B60Q 1/143 362/514 |
| 2012/0327657 | A1 | 12/2012 | Pickard et al. | |
| 2013/0003401 | A1 * | 1/2013 | Sekiguchi et al. | 362/517 |
| 2013/0163248 | A1 * | 6/2013 | Lynch et al. | 362/249.02 |
| 2013/0188377 | A1 * | 7/2013 | Konishi | 362/511 |
| 2014/0112013 | A1 * | 4/2014 | Okawa et al. | 362/516 |

FOREIGN PATENT DOCUMENTS

| | | |
|---|---|---|
| WO | 2005036054 | 4/2005 |
| WO | 2007042493 | 4/2007 |

OTHER PUBLICATIONS

Soto Salvador, Jesus, Extended European Search Report issued in EP application No. EP 14 82 0677, Oct. 13, 2016, 11 pages, European Patent Office, The Hague.

Chinese Office Action issued in Chinese application No. 201480038339.9, Nov. 16, 2016, 7 pages.

Translation of Chinese Office Action issued in Chinese application No. 201480038339.9, 6 pages.

* cited by examiner

REFLECTOR FOR DIRECTED BEAM LED ILLUMINATION

TECHNICAL FIELD

The present disclosure relates generally to a reflector for a lighting fixture. Specifically, the present disclosure relates generally to an LED reflector for an airfield runway lighting fixture.

BACKGROUND

Traditional lighting sources such as incandescent, fluorescent, high intensity discharge (HID) lamps, and the like, are gradually being replaced by light emitting diodes (LEDs) in many industries and applications. LEDs hold several advantages over traditional lighting sources such as increased power efficiency, size to output efficiency, and lifespan, among other others. Thus, many lighting fixtures are being redesigned to use LEDs instead of the traditional lighting sources. However, designing a light fixture to be compatible for use with LEDs may present a suite of engineering challenges, as LEDs typically require different drive electronics, environments, and/or optics than traditional lighting sources. Thus, in order to take advantage of the benefits of LEDs, novel lighting fixtures or LED-compatible electronics, optics, and/or housings components are required. For example, while LEDs are capable of producing a large amount of light for their size, the light is typically given off in a wide directional span. Thus, in order to take advantage of the efficiency of the LEDs and to make the light useful for a particular application, special optical features may be required. Different applications may require unique electronic, optical, or housing components in order to support LED compatibly. In other words, when designing a lighting fixture for LED compatibility, the solutions may be unique and application specific.

In the area of airfield lighting, runway lighting fixtures have typically used quartz halogen lamps, of which the light emitted is directed into a prism to produce narrow flat light desired for runway lighting. Thus, in order to effectively replace the lamps with LEDs and realize the benefits of LED lighting, it is desired to modify light emitted from the LEDs into a concentrated narrow beam, such that the beam can be efficiently directed into the prism and allow the runway light fixture to produce the desired light output.

SUMMARY

In an example embodiment of the present disclosure, a directed beam reflector includes a first reflector segment and a second reflector segment joined to the first reflector segment. The first reflector segment further includes a first curved reflective surface, in which the first reflector segment comprises a portion of a first curved three-dimensional shape. Likewise, the second reflector segment includes a second curved reflective surface, in which the second reflector segment comprises a portion of a second curved three-dimensional shape. During use, the first curved reflective surface in configured to substantially focus light from a first LED into a first beam of light. Likewise, the second curved reflective surface is configured to focus light from a second LED into a second beam of light. The first beam of light and second beam of light form an aggregate beam of light.

In another example embodiment of the present disclosure, a directed beam reflector assembly includes a circuit board and a reflector. The circuit board includes a first light emitting diode (LED) and a second LED. The reflector is disposed on the circuit board. The reflector includes a first reflector segment and a second reflector segment, in which the first reflector segment is substantially aligned with the first LED and the second reflector segment is substantially aligned with the second LED. During use, the first reflector segment focuses light from the first LED into a first beam of light and the second reflector segment focuses light from the second LED into a second beam of light. The first beam of light and second beam of light form an aggregate beam of light.

In another example embodiment of the present disclosure, a directed beam reflector includes a reflective surface. The first reflective surface includes one or more concave parabolic surfaces, in which the parabolic surfaces are substantially linearly aligned. Each of the parabolic surfaces include a portion of a paraboloid and reflects light from a light emitting diode (LED) into a focused beam of light.

BRIEF DESCRIPTION OF THE DRAWINGS

For a more complete understanding of the disclosure and the advantages thereof, reference is now made to the following description, in conjunction with the accompanying figures briefly described as follows.

Figure 1:
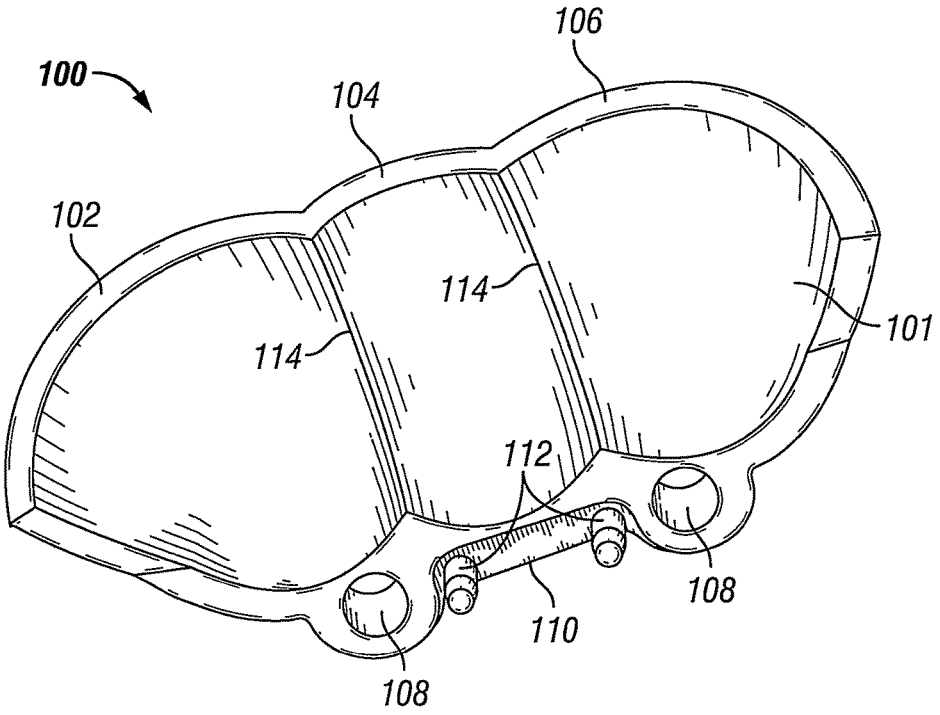
FIG. 1 illustrates a perspective bottom view of a directed beam reflector and its inner surface, in accordance with example embodiments of the present disclosure.

The drawings illustrate only example embodiments of the disclosure and are therefore not to be considered limiting of its scope, as the disclosure may admit to other equally effective embodiments. The elements and features shown in the drawings are not necessarily to scale, emphasis instead being placed upon clearly illustrating the principles of example embodiments of the present disclosure. Additionally, certain dimensions may be exaggerated to help visually convey such principles.

DETAILED DESCRIPTION OF EXAMPLE EMBODIMENTS

In the following paragraphs, the present disclosure will be described in further detail by way of examples with reference to the attached drawings. In the description, well known components, methods, and/or processing techniques are omitted or briefly described so as not to obscure the disclosure. As used herein, the "present disclosure" refers to any one of the embodiments of the disclosure described herein and any equivalents. Furthermore, reference to various feature(s) of the "present disclosure" is not to suggest that all embodiments must include the referenced feature(s). The present disclosure provides systems and methods of reflecting light emitting from LEDs into a focused beam and aggregate beam appropriate for use with airfield runway lighting features, and which provide the benefits of LED lighting while meeting the requirements for runway lighting.

In certain example embodiments, the present disclosure provides a reflector capable of directing light from one or more light sources into a narrow beam of light, in which the light beam reaches a high brightness while the light sources require less driver power relative to the brightness of the light beam. In the present disclosure, the reflector is described in an airfield lighting environment, specifically, as an optical component of an airfield runway light fixture. However, the reflector is usable in a variety of other lighting fixtures and applications other than airfield lighting. Similarly, in the present disclosure, the reflector is used with light emitting diodes (LEDs) as the one or more light sources. While the example embodiments and applications described in this disclosure use LEDs, it is to be appreciated that in other example embodiments and applications, the reflector can be used with other types of light sources while remaining within the scope of this disclosure. Any disclosure of dimensions, proportions, or particular geometries in the description or in the figures is for conceptual and example purposes and is not limiting.

Figure 2:
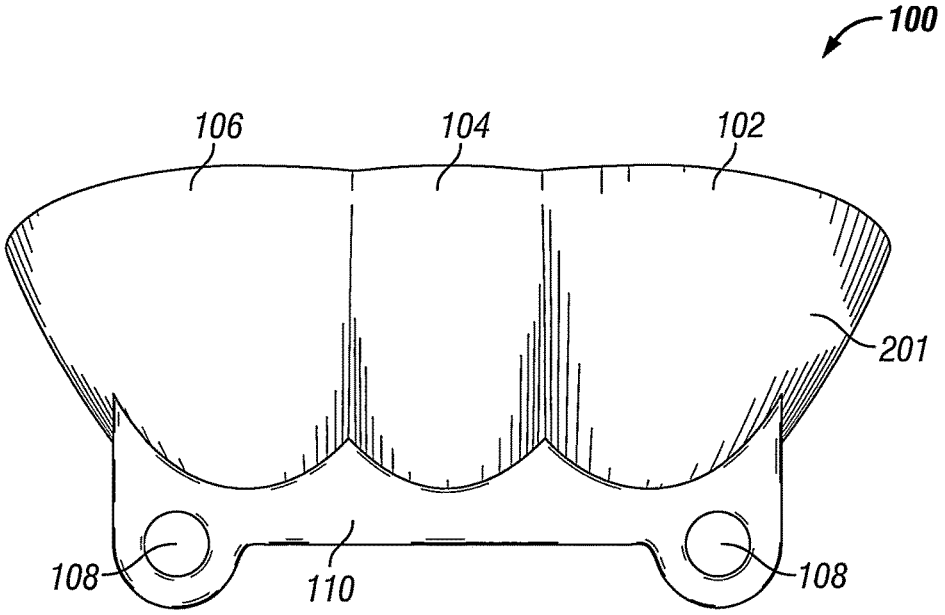
FIG. 2 illustrates a top view of the directed beam reflector of FIG. 1 and its outer surface, in accordance with example embodiments of the present disclosure.
Figure 3:
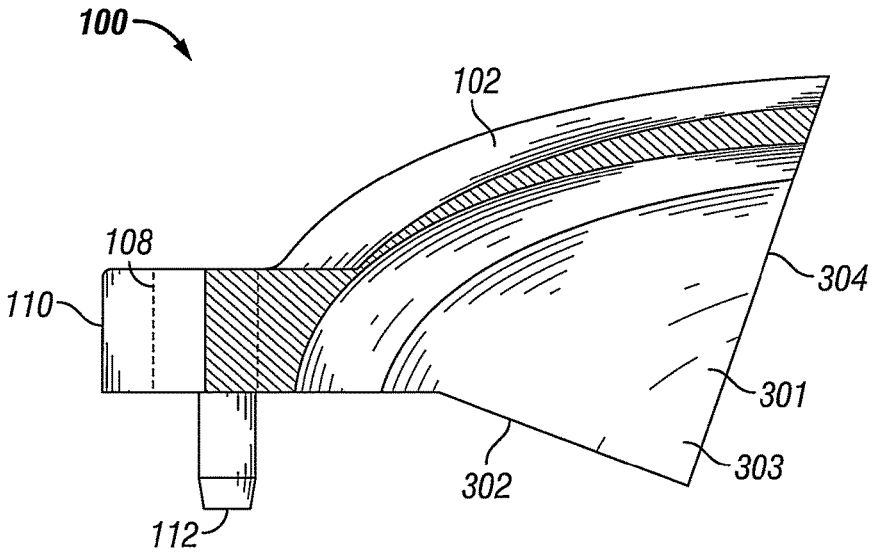
FIG. 3 illustrates a side view of the directed beam reflector of FIGS. 1 and 2, in accordance with example embodiments of the present disclosure.

FIG. 1 illustrates a perspective bottom view of a directed beam reflector 100 in accordance with example embodiments of the present disclosure. FIG. 2 illustrates a top view, or backside view, of the reflector 100 of FIG. 1, in accordance with example embodiments of the present disclosure. Specifically, FIG. 1 shows an inner surface 101 of the reflector 100 and FIG. 2 shows an outer surface 201 of the reflector 100. FIG. 3 illustrates a side view of the reflector 100 of FIGS. 1 and 2, in accordance with example embodiments of the present disclosure. Referring to FIGS. 1, 2, and 3, in certain example embodiments, the directed beam reflector 100 includes a first reflector segment 102, a second reflector segment 104, and a third reflector segment 106, in which the first reflector segment 102 is coupled to the second reflector segment 104, and the third reflector segment 106 is coupled to the second reflector segment 104 opposite the first reflector segment. In certain example embodiments, the first, second, and third reflector segments 102, 104, 106 are substantially linearly aligned. The reflector 100 further includes a mounting element, such as a mounting flange 110, coupled to at least one of the first, second, and third reflector segments. In certain example embodiments, the mounting element 110 includes a coupling element such as an aperture 108 for coupling the reflector to a mounting surface. In certain example embodiment, the mounting surface to which the reflector is to be mounted is a circuit board, a spacer, a fixture housing, or the like. In the presently illustrated embodiment, the coupling element 108 is an aperture which traverses the mounting flange 110 configured to receive a screw threaded therethrough, in which the screw secures the mounting flange 110 to a mounting surface disposed adjacent to the mounting screw. In another example embodiment, the coupling element 108 is a snap, clip, pin, slot, or the like, and the mounting surface includes a corresponding coupling feature. In certain example embodiments, the reflector includes one or more alignment elements such as alignment pins 112 for easily aligning the reflector with the mounting surface. In another example embodiment, the alignment feature is a depression, protrusion, slot, or another appropriate alignment or guide feature.

In certain example embodiments, the first reflector segment 102 includes a portion of a first curved three-dimensional shape, the second reflector segment 104 includes a portion of a second curved three-dimensional shape, and the third reflector segment 106 includes a portion of a third curved three-dimensional shape. Reflector segments 102, 104 and 106 are connected at joints 114 as shown in the example in FIG. 1. In certain example embodiments, and as illustrated in FIGS. 1 and 2, each of the first, second, and third reflector segments 102, 104, 106 are concave (FIG. 1) in the same direction, forming the inner surface 101, and convex (FIG. 2) in the same direction, forming the outer surface 201. In certain example embodiments, all or a subset of the first, second, and third curved three-dimensional shapes are paraboloids.

In certain example embodiments, the first reflector segment 102 includes a portion of a first paraboloid, in which the portion is defined or bounded by a partial revolution of the paraboloid and a plane traversing the axis of symmetry of the paraboloid. In certain example embodiments, the plane is orthogonal to the axis of symmetry. In certain other example embodiments, the plane is not orthogonal to the axis of symmetry. Likewise, the second and third reflector segments 104, 106, respectively include portions of a second and third paraboloid and are similarly defined. In certain example embodiments, the first, second, and third paraboloids have the same geometries and comprise the same shape. Alternatively, in certain example embodiments, the first, second, and third paraboloids comprise different geometries.

In certain example embodiments, the first, second, and third reflector segments 102, 104, 106 comprise same or different portions of their respective paraboloids. For example, and as illustrated in FIG. 1, the first and third reflector segments 102, 106 comprises a larger portion of their respective paraboloids and the second reflector segment 104 comprises a smaller portion of its respective paraboloid. In other words, the second reflector segment 104 is defined by fewer degrees of revolution of the second paraboloid. Thus, in certain embodiments, the first, second, and third reflector segments 102, 104, 106 have different sizes and/or surface area.

Referring to FIG. 3, in certain example embodiments, the first reflector segment 102 is on a side of the reflector 100. Thus, in such an embodiment, an outer side 301 of the first reflector also forms an outer side 301 of the reflector 100. In certain example embodiments, the outer side 301 includes a flank portion 303 which extends beyond the defined portion of the first paraboloid and includes an outer edge 302 which traverses a plane defined by the mounting surface. The configuration of the reflector 100 with respect to the mounting surface is described in further detail with reference to FIG. 5. In certain example embodiments, the flank portion 303 deviates from, or does not follow, the contour of the paraboloid.

In certain example embodiments, the reflector 100 is fabricated from a plastic material having appropriate thermal characteristics such that the reflector is able to withstand a high temperature environment, such as that associated with LED lighting. For example, in one or more example embodiments, the reflector 100 is primary fabricated from a polycarbonate material. The inner surface 101 of the reflector 100 is a reflective surface. In certain example embodiments, the inner surface 101 is coated with a reflective material such as chrome, aluminum, silver, or the like. In certain example embodiments, the process of applying such a coating is a high temperature process. Therefore the reflector 100 would be fabricated from a material of sufficient heat resistance to withstand not only an LED environment, but also the heating involved in applying a reflective coating.

Figure 4:
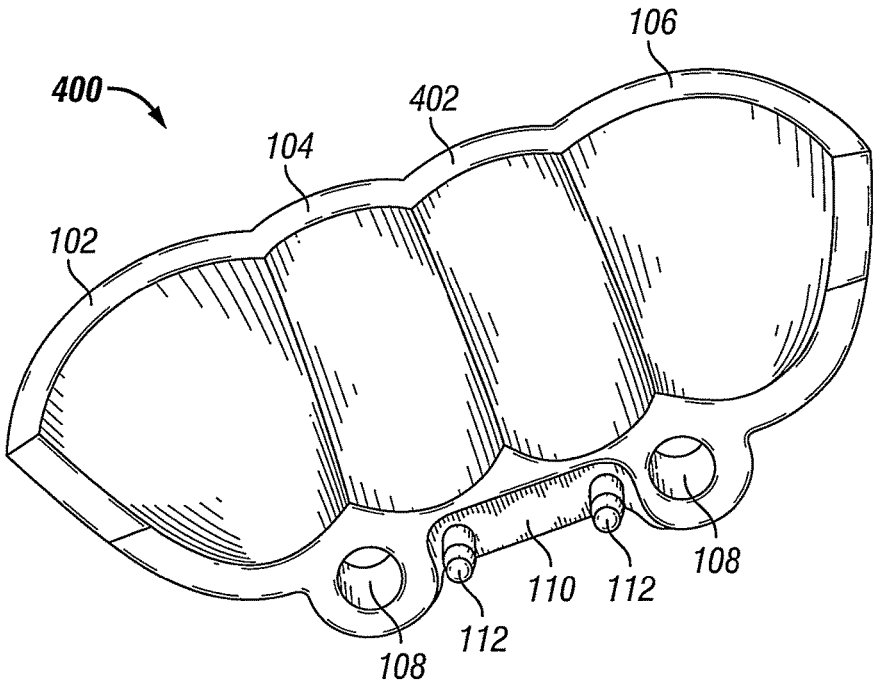
FIG. 4 illustrates a perspective bottom view of an alternate embodiment of a directed beam reflector, in accordance with example embodiments of the present disclosure.

In certain example embodiments, the reflector 100 includes more or less than three reflector segments. For example, FIG. 4 illustrates a reflector 400 having a fourth reflector segment 402 in accordance with an example embodiment of the present disclosure. Alternatively, in certain example embodiments, the reflector 100 includes only two of the first, second, and third reflector segments 102, 104, 106.

Figure 5:
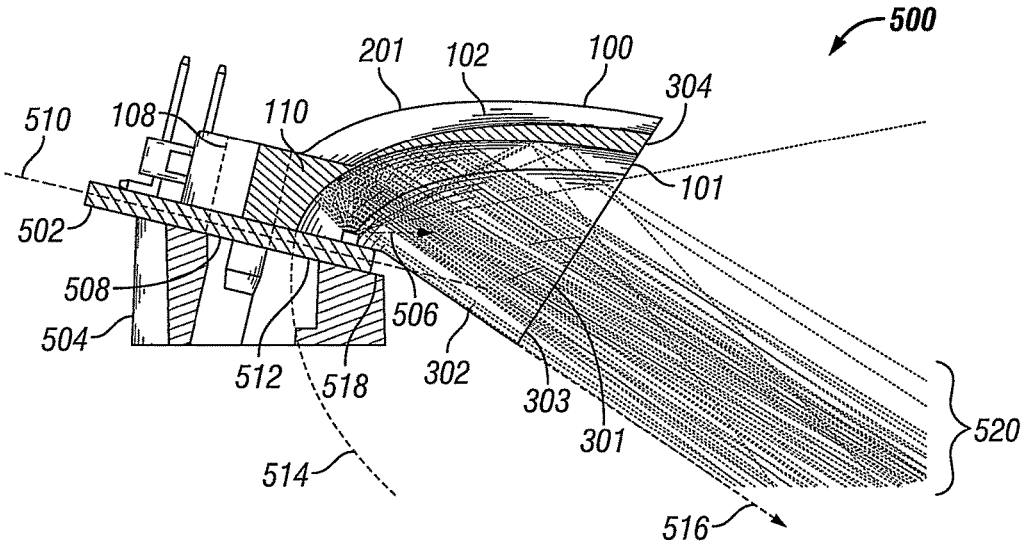
FIG. 5 illustrates a side view of a reflector assembly, in accordance with example embodiments of the present disclosure.

FIG. 5 illustrates a side view of a reflector assembly 500 featuring the reflector 100 of FIGS. 1, 2, and 3, in accordance with an example embodiment of the present disclosure. FIG. 5 further illustrates the first reflector segment 102 reflecting light from a first LED 506 into a first beam of light 520, in accordance with an example embodiment of the present disclosure. Referring to FIG. 5, in certain example embodiments, the reflector assembly 500 includes the reflector 100, a circuit board 502, and a spacer 504. In certain example embodiments, the circuit board 502 includes a coupling element 508 such as an aperture or screw-hole. The reflector 100 is mounted onto the circuit board 502 such that the aperture 108 in the mounting element 110 of the reflector and the aperture 508 in the circuit board 502 are aligned and a screw can be threaded therethrough, securing the reflector 100 to the circuit board 502. In an example embodiment, the reflector 100 is mounted onto the circuit board 502 in an orientation in which the inner surface 101 of the reflector 100 faces the circuit board 502 and the outer surface 201 of the reflector 100 faces away from circuit board 502.

In certain other example embodiments, the reflector 100 is mounted onto the circuit board 502 via a different coupling mechanism, such as a clip, snap, groove, and the like. In certain example embodiments, the circuit board 502 is mounted on a spacer 504 such that the circuit board 502 is disposed between the reflector 100 and the spacer 504. In an example embodiment, the spacer 504 includes one or more apertures or screw-holes which align with the apertures or screw-holes in the circuit board 502 and the reflector 100. In such an embodiment, a screw is threaded through the reflector 100, the circuit board 502, and the spacer 504, thereby securing the three elements to each other. In an example embodiment, the spacer 504 is also secured to an optical housing on a lighting fixture when installed. Additionally, in certain example embodiments, the alignment pins 112 of the reflector 100 provide accurate alignment and relative positioning between the reflector 100, the circuit board 502, and/or the spacer 504. In certain example embodiments, the spacer 504 is secured to the optical housing with one or more screws or another appropriate coupling device or element. In an example embodiment, the spacer 504 provides an angled surface on which the circuit board 502 is mounted, thereby providing an angle between the reflector 100 and the optical housing to which the spacer 504 is mounted. In certain example embodiments, the spacer 504 further functions as a heat sink, dissipating a portion of the heat generated by the LEDs 506.

The circuit board 502 further includes one or more LEDs 506 disposed thereon. In certain example embodiments, the LED 506 is a surface mount LED package 506. The LED 506 is directed upwards towards the inner surface 101 of the reflector 100. In one example embodiment, the circuit board 502 has as many LEDs 506 as the reflector has reflector segments, in which each LED 506 corresponds to and is positioned under one of the reflector segments. In an example embodiment, the LED 506 is positioned with respect to the first reflector segment 102. Specifically, in the example embodiment, the LED 506 and the reflector 100 are oriented on the circuit board 502 such that the LED 506 is substantially positioned at the geometric focus 512 of the first paraboloid 504, of which the first reflector segment comprises a portion, as described above. Thus, light given off by the LED 506 is reflected by the reflector 100 in a direction substantially parallel to the optical axis 516 of the first paraboloid 514, forming a first beam of light 520. In certain example embodiments, the optical axis 516 is at an angle to the circuit board 502, which directs the first beam of light 520 in the angle with respect to the circuit board 502. Such an optical angle facilitates optical efficiency of the reflector segment and the lighting fixture and/or housing in which the reflector 100 is installed. However, given that the light emitting area of the LED 506 spans an area larger than one geometric point, some of the light emitted does not originate from the exact geometric focus 512 and is reflected at an slight angle to the axis of symmetry 516. In certain example embodiments, the LED 506 can be positioned offset from the geometric focus 512 to achieve another desired lighting effect.

In certain example embodiments, the LED 506 is mounted as close to an edge 518 of the circuit board 502 as practicable, as excess surface area of the circuit board 502 may deflect more light emitted from the LED 506, reducing the overall brightness of the first beam of light 520. As discussed above, in an example embodiment, the outer side 301 of the reflector 100 includes a flank portion 303 and an outer edge 302 which traverses and extends beyond a plane 510 defined by the circuit board 502. The extra reflective surface provided by the flank portion 303 provides a stray light baffling function, which reduces the amount to light lost in the fixture and focusses more light into the first beam of light 520.

Figure 6:
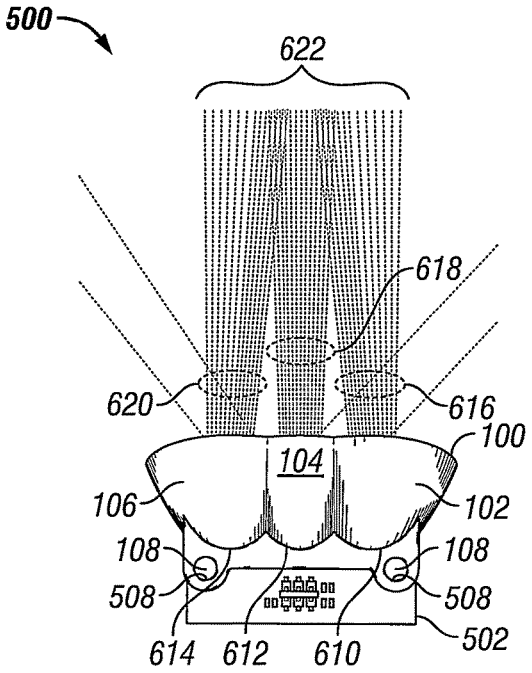
FIG. 6 illustrates a top view of the reflector assembly of FIG. 5, in accordance with embodiments of the present disclosure.

FIG. 6 illustrates a top view of the reflector assembly 500 of FIG. 5, in accordance with an example embodiment of the present disclosure. Referring to FIG. 6, in an example embodiment, the circuit board 502 includes a first LED 506, a second LED 612, and a third LED 614 mounted thereon. In the example embodiment, the reflector 100 includes the first reflector segment 102, the second reflector segment 104, and the third reflector segment 106. Accordingly, the first reflector segment 102 reflects light emitted by the first LED 506 into a first beam of light 616, the second reflector segment 104 reflects light emitted by the second LED 612 into a second beam of light 618, and the third reflector segment 106 reflects light emitted by the third LED 612 into a third beam of light 620.

In certain example embodiments, the first, second, and third beams of light 616, 618, 620 converge slightly to form an aggregate beam 622. When used in an airfield runway lighting application, such convergence generates a beam which meets Federal Aviation Administration (FAA) standards and/or international airfield standards. In certain example embodiments, the angle of convergence is defined as "full-width half maximum", or the complete width across the beam at the half power point. For example, in one embodiment, the angle of convergence is approximately 10° horizontally (left to right direction in FIG. 6) and 4.5° vertically (top to bottom direction in FIG. 5). Thus, the aggregate beam 622 is wider than it is tall. In certain example embodiments, the horizontal angle of convergence ranges from approximately 8° to 12° and the vertical angle of convergence ranges from approximately 3° to 5°. In other example embodiments, the horizontal and vertical angles of convergence are outside of these ranges.

In certain example embodiments, the reflector 100 includes more or less than three reflector segments, and the reflector assembly 500 includes more or less than three LEDs, thereby producing more or less than three light beams which converge to form the aggregate light beam. The reflector segments can be arranged differently to produce a different aggregate light beam. For example, in an embodiment, more reflector segments are arranged side by side to produce a wider aggregate light beam. Alternatively, in an example embodiment, reflector segments are arranged out of line with each other or stacked to produce an aggregate light of more height.

Figure 7:
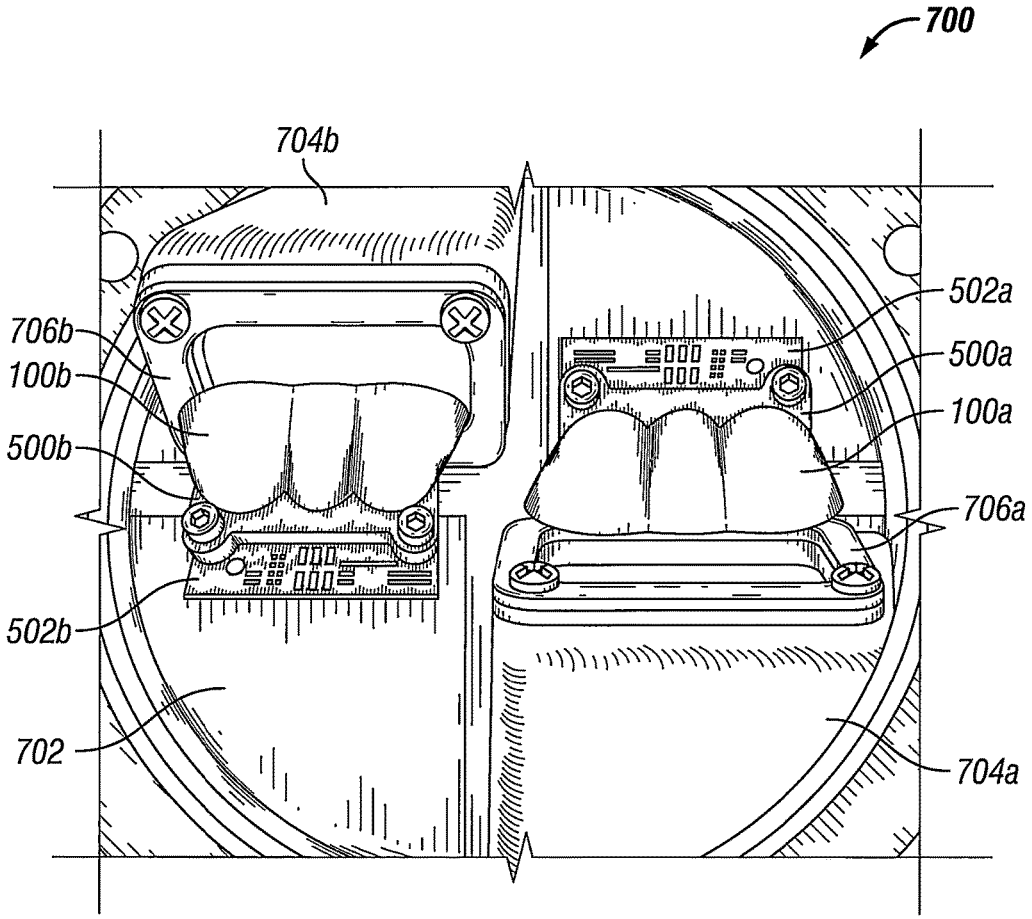
FIG. 7 illustrates an internal view of a light fixture including the reflector assembly of FIGS. 5 and 6.

FIG. 7 illustrates an internal view of a light fixture 700 using the reflector 100, in accordance with example embodiments of the present disclosure. Specifically, FIG. 7 illustrates the underside of an optical housing 702 of a runway light fixture 700. In certain example embodiments, the optical housing 702 houses certain optical and electrical components which support the function of the light fixture 700. In an example embodiment, the light fixture 700 includes a first reflector assembly 500*a* and a second reflector assembly 500*b*. Respectively, the first and second reflector assemblies 500*a*, 500*b*, include first and second reflectors 100*a*, 100*b*, and first and second circuit boards 502*a*, 502*b*. The light fixture 700 further includes a first prism housing 704*a* and a second prism housing 704*b*, which house first and second prism 706*a*, 706*b*, respectively. In the example embodiment, the first and second prisms 706*a*, 706*b* and the first and second prism housings 704*a*, 704*b* are positioned at a 180° rotation from each other so that light is emitted in opposite directions. The first and second reflector assemblies 500*a*, 500*b* are mounted onto the optical housing 702 substantially adjacent to and facing the first and second prism housings 704*a*, 704*b*, respectively as shown in FIG. 7. The prism housings 704*a*, 704*b* include a window which exposes the prisms 706*a*, 706*b* to the reflectors 100*a*, 100*b*. Specifically, the prisms 706*a*, 706*b* are substantially perpendicular to the axis of symmetry 516 (FIG. 5) of the reflector segments, such that the aggregate light beams 622 (FIG. 6) reflected by the reflectors 100*a*, 100*b* enter the prisms 706*a*, 706*b*. The light beams 622 are directed by the prisms 706*a*, 706*b* and exit the fixture 700 on the top side (not shown) in a direction substantially parallel to the ground when the fixture 700 is installed on a runway, thus providing flat and focused light for runway lighting. In certain example embodiments, the fixture 700 includes more or less than two reflector assemblies 500, and the reflector assemblies are arranged differently. In certain example embodiments, the light fixture 700 is an elevated runway light or another type of airfield lighting fixture.

Although embodiments of the present disclosure have been described herein in detail, the descriptions are by way of example. The features of the disclosure described herein are representative and, in alternative embodiments, certain features and elements may be added or omitted. Additionally, modifications to aspects of the embodiments described herein may be made by those skilled in the art without departing from the spirit and scope of the present disclosure defined in the following claims, the scope of which are to be accorded the broadest interpretation so as to encompass modifications and equivalent structures.

What is claimed is:

1. A directed beam reflector, comprising:

a first reflector segment comprising a first curved reflective surface, wherein the first reflector segment comprises a portion of a first curved three-dimensional shape, and wherein the first reflector segment has a first optical axis;

a second reflector segment comprising a second curved reflective surface and that is joined to the first reflector segment, wherein the second reflector segment comprises a portion of a second curved three-dimensional shape, and wherein the second reflector segment has a second optical axis;

a mounting flange integral to the directed beam reflector and configured to mount the directed beam reflector onto a circuit board having a first light emitting diode (LED) and a second LED disposed adjacent to an edge of the circuit board such that the first LED corresponds to and is positioned facing an inner surface of the first reflector segment and the second LED corresponds to and is positioned facing an inner surface of the second reflector segment; and a first side edge of the first reflector segment and a second side edge of the second reflector segment, the first and second side edges extending past a plane defined by the circuit board, wherein the directed beam reflector is mounted on the circuit board such that:

the inner surface of the first reflector segment extends behind the first LED and towards the circuit board, the inner surface of the second reflector segment extends behind the second LED and towards the circuit board, and the circuit board forms a non-zero acute angle with respect to the first optical axis and the second optical axis to improve an optical efficiency of the first reflector segment and the second reflector segment, wherein the first reflector segment substantially focuses light from the first LED into a first beam of light that is directed at the non-zero acute angle with respect to the circuit board and the second reflector segment substantially focuses light from the second LED into a second beam of light that is directed at the non-zero acute angle with respect to the circuit board; and wherein the first beam of light and the second beam of light form an aggregate beam of light.

2. The directed beam reflector of claim 1, further comprising a third reflector segment joined to the second reflector segment opposite the first reflector segment, the third reflector segment comprising a third curved reflective surface and a portion of a third curved three-dimensional shape.

3. The directed beam reflector of claim 2, wherein the first and third reflector segments comprise larger portions of the first and third curved three-dimensional shapes, respectively, than the second reflector segment comprises of the second curved three-dimensional shape.

4. The directed beam reflector of claim 1, wherein the first curved three-dimensional shape, the second curved three-dimensional shape, or both is a paraboloid.

5. The directed beam reflector of claim 1, wherein the first curved three dimensional shape and the second three dimensional shape are the same.

6. The directed beam reflector of claim 1, wherein the aggregate beam of light comprises an angle of convergence of approximately 10 degrees in the horizontal direction.

7. A directed beam reflector assembly, comprising:

a circuit board comprising a first light emitting diode (LED) and a second LED, wherein the circuit board defines a plane, and wherein the circuit board comprises one or more coupling apertures for coupling to a reflector; and the reflector comprising:

a first reflector segment having a first optical axis and a second reflector segment having a second optical axis, wherein the first reflector segment and the second reflector segment are joined and wherein the first reflector segment is substantially aligned with the first LED and the second reflector segment is substantially aligned with the second LED, wherein the reflector comprises a right edge and a left edge, wherein the right and left edges extend beyond the plane defined by the circuit board; and a mounting flange integral to the reflector and configured to mount the reflector onto the circuit board, wherein the reflector is mounted on the circuit board such that:

an inner surface of the first reflector segment extends behind the first LED and towards the circuit board, an inner surface of the second reflector segment extends behind the second LED and towards the circuit board, and the plane of the circuit board forms a non-zero acute angle with the first optical axis and the second optical axis to improve an optical efficiency of the first reflector segment and the second reflector segment, and wherein the first reflector segment substantially focuses light from the first LED into a first beam of light that is directed at the non-zero angle with respect to the plane defined by the circuit board; the second reflector segment substantially focuses light from the second LED into a second beam of light that is directed at the non-zero angle with respect to the plane defined by the circuit board; and the first beam of light and second beam of light form an aggregate beam of light.

8. The directed beam reflector assembly of claim 7, wherein the mounting flange is mounted on the circuit board and the circuit board is coupled to a spacer via one or more screws.

9. The directed beam reflector assembly of claim 8, wherein the spacer includes one or more apertures that are aligned with the one or more coupling apertures of the circuit board and the reflector when the circuit board and the reflector are mounted onto the spacer.

10. The directed beam reflector assembly of claim 7, wherein:

the first reflector segment comprises a first curved reflective surface and a portion of a first curved three-dimensional shape; and the second reflector segment comprises a second curved reflective surface joined to the first reflector segment, and comprises a portion of a second curved three-dimensional shape.

11. The directed beam reflector assembly of claim 10, wherein the reflector further comprises a third reflector segment joined to the second reflector segment opposite the first reflector segment, the third reflector segment comprising a third curved reflective surface and a portion of a third curved three-dimensional shape.

12. The directed beam reflector assembly of claim 10, wherein the first curved three-dimensional shape and the second curved three-dimensional shape comprise first and second paraboloids, respectively.

13. The directed beam reflector assembly of claim 12, wherein the first LED is positioned at approximately a geometric focus of the first paraboloid.

14. The directed beam reflector assembly of claim 7, wherein the directed beam reflector assembly is placed adjacent to a prism housing in the optical housing such that the aggregate beam of light from the reflector enters the prism housing through a prism housing window and is directed by a prism in the prism housing to exit the optical housing.

15. A directed beam reflector, comprising:

a reflective surface comprising one or more concave parabolic surfaces, a first edge and a second edge; and a mounting flange by which the directed beam reflector is mountable to a circuit board structure having one or more light emitting diodes (LEDs) corresponding to the one or more concave parabolic surfaces, the circuit board structure defining a plane, wherein the first and second edges of the reflective surface traverse and extend beyond the plane defined by the circuit board structure, wherein the one or more concave parabolic surfaces are substantially linearly aligned, wherein the directed beam reflector is mounted on the circuit board such that:

an inner surface of the one or more concave parabolic surfaces extends behind the one or more LEDs disposed on the circuit board, and an optical axis of each of the one or more concave parabolic surfaces forms a non-zero acute angle with respect to the plane defined by the circuit board to improve an optical efficiency of the reflective surface, and wherein each of the one or more concave parabolic surfaces comprise a portion of a paraboloid that reflects light from the corresponding LED into a focused beam of light that is directed at the non-zero acute angle with respect to the circuit board, wherein the beams of light of the one or more concave parabolic surfaces converge to form an aggregate beam of light that is wider than it is tall, width being measured in a horizontal direction traversing the one or more concave parabolic surfaces.

16. The directed beam reflector of claim 15, wherein a horizontal convergence of the aggregate beam of light is approximately 8 to 12 degrees and a vertical convergence of the aggregate beam of light is approximately 3 to 5 degrees.

17. The directed beam reflector of claim 15, wherein the first and second edges of the reflective surface that traverse and extend beyond the plane defined by the circuit board structure deviate from a contour of the respective paraboloid.

* * * * *